US005565150A

United States Patent [19]

Dillehay et al.

[11] Patent Number: 5,565,150

[45] Date of Patent: Oct. 15, 1996

[54] ENERGETIC MATERIALS PROCESSING TECHNIQUE

[75] Inventors: David R. Dillehay; David W. Turner, both of Marshall; Horace L. Wingfield, III, Longview, all of Tex.; James A. Blackwell, Shreveport, La.

[73] Assignee: Thiokol Corporation, Ogden, Utah

[21] Appl. No.: 336,309

[22] Filed: Nov. 8, 1994

Related U.S. Application Data

[63] Continuation-in-part of Ser. No. 170,391, Dec. 20, 1993, Pat. No. 5,487,851.

[51] Int. Cl.[6] ..... C06B 21/00

[52] U.S. Cl. ..... 264/3.3

[58] Field of Search ..... 264/3.3

[56] References Cited

U.S. PATENT DOCUMENTS

| | | | |
|---|---|---|---|
| 2,768,072 | 10/1956 | Stark | 52/5 |
| 3,138,501 | 6/1964 | Wright | 149/92 |
| 3,173,817 | 3/1965 | Wright | 149/2 |
| 3,400,025 | 9/1968 | Hopper et al. | 149/18 |
| 3,872,192 | 3/1975 | Kaufman et al. | 264/3 B |
| 4,263,070 | 4/1981 | Price et al. | 149/19.4 |
| 4,428,786 | 1/1984 | Arni | 149/21 |
| 4,506,069 | 3/1985 | Barnes et al. | 528/232 |
| 4,525,313 | 6/1985 | Muller | 264/3 B |
| 4,554,031 | 11/1985 | Kerviel et al. | 149/19.3 |
| 4,570,540 | 2/1986 | Bell | 102/202 |
| 4,585,600 | 4/1986 | Rollyson et al. | 264/3.3 |
| 4,650,617 | 3/1987 | Kristofferson et al. | 264/3.3 |
| 4,919,737 | 4/1990 | Biddle et al. | 149/19.5 |
| 4,976,794 | 12/1990 | Biddle et al. | 149/19.5 |
| 5,026,443 | 6/1991 | Müller et al. | 149/18 |
| 5,114,630 | 5/1992 | Newman et al. | 264/3.1 |
| 5,125,684 | 6/1992 | Cartwright | 280/736 |
| 5,266,242 | 11/1993 | Mogendorf et al. | 264/3.3 |

*Primary Examiner*—Peter A. Nelson

*Attorney, Agent, or Firm*—Madson & Metcalf; Ron Lyons

[57] ABSTRACT

Energetic materials are continuously processed in a twin-screw extruder to provide safe, low-cost, high quality manufacturing of pyrotechnic compositions, gun propellants, and high explosives. The energetic materials are processed by first lacquering the binder and other soluble ingredients in a solvent. The lacquer solution is introduced into a twin-screw extruder. At least one solid reactive material ingredient, such as metal and/or oxidizer particles, is also introduced into the twin-screw extruder. The solid reactive material ingredient and the lacquer solution are mixed within the twin-screw extruder. After mixing, sufficient solvent is removed by heating or by vacuum to permit bulk granulation of the energetic material. Moist energetic material is then granulated using a remote continuous rotary granulator. The energetic material is dried to produce free-flowing granules which may be used as feedstock for further processing.

31 Claims, No Drawings

ENERGETIC MATERIALS PROCESSING TECHNIQUE

RELATED APPLICATION

The present application is a continuation-in-part of application Ser. No. 08/170,391, filed Dec. 20, 1993, now U.S. Pat. No. 5,487,851 and entitled "COMPOSITE GUN PROPELLANT PROCESSING TECHNIQUE" which application is incorporated herein by this reference.

FIELD OF THE INVENTION

The present invention relates to an improved method of processing energetic materials such as pyrotechnic compositions, propellants, and explosives. More particularly, the process of the present invention is directed to the continuous mixing of energetic materials in a twin-screw extruder followed by granulating and drying. The disclosed process improves quality of the final product, personnel safety, and production efficiency.

BACKGROUND OF THE INVENTION

Many energetic materials, such as pyrotechnic flare compositions, gun propellants, and pressable explosives are manufactured entirely in batch processes. In these batch processes, materials are dried, as required, and weighed into discrete batch size portions for mixing in standard muller-type, vertical planetary mixers, or in horizontal sigma-blade mixers. The ingredients are mixed and further processed into end items. The batch mixing is time consuming, costly, marginally homogeneous, and exposes both operators and equipment to significant hazards from accidental ignition.

For instance, a current process for manufacturing infrared decoy flare compositions uses a muller-type mixer to compound the ingredients. In this process, polyacrylate rubber binder is dissolved in acetone and weighed into a mixer. Fine (20 micron) magnesium powder is added to the mixer and premixed to wet the metal powder. Polytetrafluoroethylene (PTFE) is added to the mix and the slurry is mixed until the acetone evaporates to form a putty-like consistency. When the putty is ready to dump, the operator enters the bay in an aluminized suit (for safety) and places a container under the dump door on the mixer. The mix is remotely dumped to fill the container and the operator removes that container and repeats the process until the mixer is empty. The putty-like composition is spread on trays and placed in large walk-in ovens for complete drying. After drying, the trays are removed and the cakes are broken into chunks that can be granulated for feedstock to the process. The granulating process uses a Stokes granulator which rubs the chunks against a screen. This granulating process has been known to accidentally ignite the pyrotechnic flare composition with subsequent destruction of the facility.

In this process, there are numerous exposures of personnel to bulk quantities of flare composition. This is a significant safety hazard. The drying of bulk quantities of flare composition in ovens is a hazard to facilities and personnel. The mixing time is long since the mixers are not heated and the evaporation of the acetone cools the bowls and retards drying. The Muller-type mixers are not efficient in combining the solids nor in separating the entwined fibers of the PTFE. After granulation, the material is not free-flowing and must be manually weighed, dispensed, and leveled in the dies for consolidation. From start to finish, the process is time consuming and labor intensive requiring several days to complete.

Another process for manufacturing infrared decoy flare compositions uses a "shock precipitation" or "Cowles Dissolver" method. In this process, the binder is dissolved in acetone and placed in a Cowles Dissolver. The PTFE is added and the high-shear mixing of the Cowles Dissolver disperses the PTFE fairly efficiently. The magnesium powder is added to the mixer while mixing, and hexane is added to cause the binder to precipitate from the acetone to coat the solids suspended in the mixture. The mixing is stopped and the solids settle to the bottom. The mixed solvents are decanted, and the solids are washed with additional hexane. The solids are trayed for drying in a large walk-in oven. Again, the batch mixing is labor intensive and results in considerable exposure of personnel and facilities to large quantities of hazardous composition. The process is also time consuming and results in major waste disposal problems.

It will be appreciated that infrared decoy flare compositions are hazardous pyrotechnic formulations that produce extreme heat when ignited. Current batch processes require considerable exposure of personnel and equipment to large quantities of bulk material because it is not possible to operate the process remotely.

Typical composite low vulnerability ammunition ("LOVA") gun propellants, of the type described in U.S. Pat. No. 4,570,540, are prepared in a batch process using a solvent, which requires relatively long processing times and a large number of steps. In a common LOVA gun propellant batch manufacturing process, RDX is dried, ground to a desired particle size, and weighed into a batch size increment for mixing. The other gun propellant ingredients (binder, plasticizer, liquid coupling agent, and stabilizer) are added to a horizontal, sigma blade mixer that has been modified to eliminate seals around the blade shafts. Vertical mixers are precluded from this process because the very high viscosity results in inadequate mixing capability. The ingredients are wet with a mixed ethyl acetate/ethyl alcohol solvent. The materials are mixed for several hours to assure that the organic binder materials are dissolved and coated onto the RDX. The temperature of the mixer is controlled during this entire cycle so that the solvent mixture is not removed prematurely. When the mix cycle reaches a proper time, determined by the amount of mix energy introduced into the propellant, a vacuum is applied and the solvent level is reduced over a period of time to the proper operating level.

The mix is then dumped and transferred to the blocking and straining area. Approximately 60 pounds of LOVA is put into a die and pressed into a cylinder approximately 12 inches in diameter and 16 inches long. The block is placed in a ram extruder and pressed through a sieve plate to put additional work into the propellant to improve mixing. The spaghetti-like strands are collected and re-pressed in the die. The cylinder is transferred to a large ram press with 30 dies. Each die is approximately 0.33 inch in diameter with a 19 perf pin plate to make a perforated grain for the gun propellant. The 60 pound block is extruded in a vertical plane with each strand being collected in a spiral around a cone beneath the die. As the strands exit the dies, the weight of the strands causes an elongation of the strands and a necking down of the diameter. This produces a variable diameter strand that affects the reproducibility of the grains. The solvent content is approximately 10% during extrusion.

The flexible strands are then fed to a rotating blade cutter and cut into pellets approximately 0.5 inches long. The pellets are collected, dried, glazed with graphite to prevent static charges and improve packing, and stored for several weeks to "age" the propellant before it is ballistically accepted. This batch process is costly and very labor intensive. Moreover, the efficiency of the batch mixer produces less than ideal homogeneity and performance reproducibility.

Certain high explosives, such as PAX-type (Picatinny Arsenal Explosive) explosives are processed the same as LOVA gun propellant, except the die is not perforated and the diameter is about 0.09 inches. As in the batch processing techniques described above, homogeneity is a problem. The bulk density of the explosive is controlled by extrusion and chopping of the extrudate, which significantly increases the cost.

From the foregoing, it would be an advancement in the art to provide continuous processing techniques capable of producing high quality, low cost energetic materials. It would be a significant advancement in the art to provide continuous, remotely operated techniques for processing energetic materials and to provide techniques for processing energetic materials which reduce the exposure of personnel and equipment to large quantities of bulk material. It would be yet another advancement in the art to provide energetic materials processing techniques which produce free-flowing granules having a consistent density so that volumetric materials processing equipment may be used in preparing the final energetic composition.

Such energetic materials processing techniques are disclosed and claimed herein.

SUMMARY OF THE INVENTION

The present invention relates to the processing of energetic materials in a twin-screw extruder. The production technique is a continuous process for safe, low-cost, high quality manufacturing of energetic materials including pyrotechnic compositions, gun propellants, and high explosives.

Energetic materials are processed according to the present invention by first lacquering the soluble ingredients. The lacquer solution, which contains the binder and other soluble ingredients dissolved in a solvent, is introduced into a twin-screw extruder. At least one solid reactive material ingredient, such as metal or oxidizer particles, is also introduced into the twin-screw extruder. The solid reactive material ingredient and the lacquer solution are mixed within the twin-screw extruder. After mixing, sufficient solvent is removed by heating or by vacuum to permit bulk granulation of the energetic material by the screws. The moist energetic material is then preferably granulated using a remote continuous rotary granulator. The energetic material is dried to produce free-flowing granules which may be used as feedstock for further processing.

DETAILED DESCRIPTION OF THE INVENTION

In the process of the present invention, energetic materials are continuously processed in a twin-screw extruder. This is possible by first lacquering the binder and other soluble ingredients in a solvent. The lacquer solution is then introduced into the twin-screw extruder. At least one solid reactive material ingredient, such as metal and/or oxidizer particles, is also introduced into the twin-screw extruder. The solid reactive material ingredient and the lacquer solution are mixed within the twin-screw extruder. After mixing, sufficient solvent is removed by heating or by vacuum to permit bulk granulation of the energetic material by the screws. The moist, bulk granulated energetic material is then preferably granulated using a remote continuous rotary granulator. The energetic material is dried to produce free-flowing granules which may be used as feedstock for further processing.

As used herein, the term "bulk granulation" is achieved when the solvent content is reduced to the point that the material takes on a "crumbly" nature and breaks into small chunks as it leaves the extruder. The energetic material is preferably dry enough to be moved by conveyor to a continuous granulator without sticking to the conveyor belt. Satisfactory bulk granulation is important to permit automated equipment to handle the energetic material.

The present invention is particularly suitable for preparing pyrotechnic compositions, such as infrared flare compositions, gun propellants, such as composite LOVA gun propellants, and high explosives, such as PAX-4 and PAX-2A insensitive explosives. These various classes of energetic materials are discussed in greater detail below.

Composite Gun Propellant

Energetic materials such as gun propellants and explosives are prepared by first dissolving the binder and the other the soluble ingredients, except the oxidizer, in a solvent to form a lacquer solution. The lacquer solution and solid oxidizer are then mixed in a twin-screw extruder. Sufficient solvent is removed after the ingredients are mixed to permit bulk granulation by the screws. Following this step, the gun propellant is remotely granulated using a continuous granulator. The commercially available Prater Rota-Sieve is currently preferred. This process produces a free-flowing granular material of low bulk density that can be dried of solvent and stored until needed.

Typical oxidizing agents include high performance solid nitramines such as RDX (1,3,5-trinitro-1,3,5-triaza-cyclohexane), HMX (1,3,5,7-tetranitro-1,3,5,7-tetraaza-cyclooctane), CL-20 (also known as HNIW, 2,4,6,8,10,12-hexanitro-2,4,6,8,10,12-hexaazatetracyclo[5.5.0.0$^{5,9}$0$^{3,11}$]-dodecane), and mixtures thereof. The gun propellant compositions processed according to the present invention typically include from 70% to 80% oxidizer, by weight.

The binder used in composite gun propellant processed according to the present invention must be soluble in a volatile solvent which will not dissolve the oxidizer. Cellulose ester binders are preferred binders. Examples of common cellulose ester binders which may be use in the composite gun propellant formulations include cellulose acetate (CA), cellulose acetate butyrate (CAB), and cellulose acetate propionate (CAP). Nitrocellulose is a toughener which is preferably included in the gun propellant. Other binders, such as Hytrel thermoplastic elastomers and oxetane thermoplastic elastomers may also be used in the present invention. The gun propellant compositions processed according to the present invention typically include from 5% to 15% binder, by weight.

Energetic and nonenergetic plasticizers may be used, depending on whether low energy (LE) or high energy (HE) gun propellants are desired. Known and novel energetic plasticizers may be used, such as bis(2,2-dinitropropyl)acetal/bis(2,2-dinitropropyl)formal (BDNPF/BDNPA), trimethylolethanetrinitrate (TMETN), triethyleneglycoldinitrate (TEGDN), diethyleneglycoldinitrate (DEGDN), nitroglycerine (NG), 1,2,4-butanetrioltrinitrate (BTTN), alkyl nitratoethylnitramines (NENA's), or mixtures thereof. Typical nonenergetic plasticizers include triacetin, acetyltriethylcitrate (ATEC), dioctyladipate (DOA), isodecylperlargonate (IDP), dioctylphthalate (DOP), dioctylmaleate (DOM), dibutylphthalate (DBP), or mixtures thereof. The gun propellant compositions processed according to the present invention typically include from 5% to 10% plasticizer, by weight.

The stabilizers used in the gun propellant formulations herein also serve to gelatinize the propellant. Suitable stabilizers are usually substitution products of ureas and amines. A currently preferred stabilizer is ethyl centralite (diethyl diphenyl urea). Other diphenyl amines and diphenyl ureas, such as methyl diphenyl urea and ethyl diphenyl urea may also be used herein. Stabilizers are typically included in the gun propellant formulations at a concentration from about 0.2% to 1%, by weight.

The optional liquid coupling agent (LICA) is designed to help wettability by providing a molecular bridge between the inorganic and organic interfaces in the formulation. A currently preferred liquid coupling agent is titanium(IV) neoalkoxytris(diisoocto)phosphato also known as LICA-12.

The solvent system will vary depending on the choice of oxidizer and binder. The gun propellant solvent is selected to dissolve the non-oxidizer ingredients and to adequately wet, but not dissolve, the oxidizer particles. Some solvent must be present during the final extrusion such that the binder remains plasticized. Thus, excess solvent is removed as the ingredients pass through the extruder.

Mixed solvent systems may be particularly useful in the manufacturing processes of the present invention. For instance, a mixture of solvents having different boiling temperatures may be chosen such that the excess solvent is low boiling while the high boiling solvent is present in an amount sufficient to permit extrusion of the propellant formulation. Thus, a suitable temperature profile which evaporates the excess solvent, yet retains the solvent needed for extrusion, is easily maintained.

Suitable solvents are preferably selected from commonly used organic solvents such as ketones, esters, and alcohols. Typical ketones include acetone and methyl ethyl ketone (MEK). Typical esters include acetates such as methyl acetate, ethyl acetate, and butyl acetate. Typical alcohols include methanol, ethanol, isopropyl alcohol, and propanol.

The screw configuration may be varied by those skilled in the art to achieve the desired level of mixing and solvent removal. For example, a typical screw configuration will include a conveying section where the ingredients are introduced into the extruder, one or more kneading sections where the ingredients are mixed, a section to cause the ingredients to completely fill that screw section and create a dynamic seal, a conveying section in which a vacuum may be applied to facilitate solvent removal, and another section designed to fill the screw section to maintain vacuum. Those skilled in the art understand that the optimal screw configuration depends on composition being mixed, including the composition's ingredients and solvent content.

Following compounding, bulk granulation, granulation, and drying, the low density, granular material may be analyzed for composition by chemical analysis and performance characteristics by ballistic tests, such as closed bomb, prior to final extrusion or consolidation. Energetic material that does not meet performance characteristics can be reprocessed. Because the granular material has a low density, it is easier to recompound for formulation adjustment.

The dried, granular product can be fed by a loss-in-weight feeder to a twin-screw extruder and the proper amount of solvent introduced for re-compounding to the proper consistency for extrusion. The granulation and reprocessing at proper solvent levels result in a better quality product and permit higher processing rates.

Tests have shown that gun propellant can be granulated at a solvent level between 5% and 20%. Extrusion of the final gun propellant product (based on a cellulose ester binder) is preferably accomplished at solvent levels from 10.25% to 10.75%. The close tolerance required for final extrusion can be easily met by feeding dry propellant feedstock from a loss-in-weight feeder and pumping the required solvent at a controlled rate into an extruder. The solvent conditions the binder coating to allow extrusion to shape in dies. The solvent can be varied in makeup and concentration to optimize the characteristics of the propellant.

Higher throughput with this process results from the reduction in control of solvent level. By bringing the initial formulation off at a higher solvent content than required for final extrusion, the compound can operate at a higher rate. Controlled drying of the intermediate feedstock permits solvent vapor emission recovery. When adding the solvent for extrusion, the extruder can operate at a higher rate since there is no loss of solvent in the re-mixing process. Operating the second extrusion in a closed loop mode allows better control of solvent emissions for environmental considerations. Final drying of the product and completion of propellant processing is according to conventional processes.

Pyrotechnic Flare Compositions

Pyrotechnic energetic materials, such as infrared decoy flares, are prepared using essentially the same technique as the gun propellant compositions discussed above. The soluble ingredients, except the metal fuel, are dissolved in a solvent to form a lacquer solution. The oxidizer is preferably dispersed in the lacquer solution, such that the lacquer solution forms a slurry. The slurry and solid metal are then mixed in the twin-screw extruder. Sufficient solvent is removed after the ingredients are mixed to permit bulk granulation. Following bulk granulation, the energetic material is remotely granulated using a continuous granulator. The commercially available Prater Rota-Sieve is a currently preferred continuous granulator. This process produces a free-flowing granular material of low density that can be dried of solvent and surged for a period of time.

The binder used in infrared decoy flare compositions varies depending on the production technique. For instance, pressed flare compositions utilize a polyacrylate rubber binder at a relatively low concentration. One suitable polyacrylate rubber is sold under the name HyTemp by Zeon Chemical. Extruded flare compositions utilize an energetic fluoroelastomer binder at high concentration to allow extrusion to complex internal configurations. Typical fluoroelastomer binders include Viton® A (a fluorinated ethylene propylene copolymer sold by DuPont) and Fluorel® 2175 (a chlorinated and fluorinated elastomer sold by 3M, comparable to Viton® A).

The pyrotechnic pressed flare compositions processed according to the present invention typically include from 4% to 8% binder, by weight. Extruded flare compositions typically include a binder concentration in the range from 13% to 17%, by weight.

The binder is dissolved in an organic solvent to form the lacquer solution. The lacquer solution will typically contain from 8% to about 16% binder, by weight, and preferably from about 10% to about 12% binder, by weight. The desired solvent system will vary depending on the chosen ingredients. The solvent is selected to dissolve the binder and to adequately wet the metal particles.

Suitable solvents are preferably selected from commonly used organic solvents such as ketones, esters, and alcohols. Typical ketones include acetone and methyl ethyl ketone (MEK). Typical esters include acetates such as methyl acetate, ethyl acetate, and butyl acetate. Typical alcohols include methanol, ethanol, isopropyl alcohol, and propanol. Acetone is a currently preferred solvent. If necessary, a mixed solvent system may be used.

Magnesium powder is the preferred fuel. Aluminum and magnalium (magnesium-aluminum alloy) may also be used. The reactive metal is preferably present in the pyrotechnic flare composition at a concentration in the range from 60% to 70%, by weight.

The oxidizer used in the infrared flare compositions is preferably polytetrafluoroethylene (PTFE). The particle sizes of PTFE range from 5 micron weight mean diameter (WMD) up to 500 micron WMD ground particles. The larger particles are fibrous in nature and very difficult to disperse in conventional muller-type mixers. After pressing or extrusion, the PTFE forms a solid matrix with the magnesium powder dispersed throughout the composition.

For twin screw extrusion, the PTFE is preferably dispersed in the lacquer solution and pumped into the extruder as a slurry. The high solids loading produces a thixotropic mixture that requires pressurization to make it flow into the pump. By using a densitometer with a mass flow meter or a loss-in-weight feeder, an accurate determination of the mass flow into the extruder can be maintained. For production, the slurry can be mixed as a master batch and verified for composition. The master batch is maintained in a controlled suspension for recharging the feeder to the extruder.

Excellent results have also been obtained by pumping the PTFE slurry through a colloid mill to better disperse the PTFE fibers. The slurry volume is reduced by about ⅓ after colloidization. It is also observed that the colloidized slurry has a more homogeneous density and appearance.

The solid magnesium powder for the flares can be fed to the extruder in two ways. First, the powder is fed to the extruder as a dry powder flowing from loss-in-weight feeders. This has the advantage of minimal preparation but the disadvantage of potential dusting problems. Alternatively, the magnesium powder is dispersed in a binder solution and pumped into the extruder through a mass flow meter or from a loss-in-weight feeder. A densitometer monitors the composition while pumping. This has the advantage of eliminating dusting and providing for rapid and homogeneous mixing of two slurries.

After feeding the ingredients into the twin-screw extruder, the screw configuration and operating parameters, such as speed of rotation and temperature profile, provide efficient mixing. A typical screw configuration will include a conveying section where the ingredients are introduced into the extruder, one or more kneading sections where the ingredients are mixed, a section to cause the ingredients to completely fill that screw section and create a dynamic seal, a conveying section in which a vacuum may be applied to facilitate solvent removal, and another section designed to create a seal for the vacuum section. Those skilled in the art understand that the optimal screw configuration depends on the composition being compounded, including the composition's ingredients and solvent content.

For pressed flare compositions having a binder content in the range from about 4% to 8% by weight, the extruder preferably includes turbine screw elements to provide uniform granulation. The solvent level is reduced in the extruder from about 35% at the inlet to less than 5% at the discharge end. With this solvent level, the product is fed to a continuous plate dryer to reduce the solvent level to less than 0.05% for final processing. The granular output from the dryer is containerized in quantities suitable for issuing to the production lines in a safe and efficient manner. Automatic dispensing to the pressing dies is possible with the free-flowing granular material.

The higher level of binder content, typically from 13% to 17%, by weight, required for extruded flare compositions requires a different granulation approach. There is an interrelationship between feed rates, temperature, solvent content, screw configuration and the ability to granulate. Optimum conditions appear to be between 5% and 10% acetone content (by weight) at the exit to produce good flare material for further processing. An on-line continuous granulator has been found to produce excellent, homogeneous material. A 4 mesh screen on the continuous granulator produced a free-flowing, granular composition that could be handled easily. Up to 15% acetone wet flare composition has been successfully granulated. The granular material can be analyzed prior to further processing. The uniform bulk density and free-flowing characteristics allow automatic charging of ram extruders.

High Explosive

High explosives are processed according to the present invention by dissolving the binder and the other the soluble ingredients, except the oxidizer, in a solvent to form a lacquer solution. The lacquer solution and solid oxidizer are then compounded (mixed) in the twin-screw extruder. Sufficient solvent is removed after the ingredients are mixed to permit bulk granulation by the screws. Following this step, the explosive composition is remotely granulated using a continuous granulator, such as the Prater Rota-Sieve. This process produces a free-flowing granular material of low bulk density that can be dried of solvent and packaged for shipment to the loading facility.

Typical oxidizing agents include high performance solid nitramines commonly used in explosive compositions, such as RDX, HMX, CL-20, ADN (ammonium dinitramide), TNAZ (1,3,3-trinitroazetidine), and mixtures thereof. The high explosive composition typically contains from 80% to 90% oxidizer, by weight.

The binder used to prepare the high explosive composition according to the present invention must be soluble in a volatile solvent which will not dissolve the oxidizer. Cellulose ester binders is preferred binders. Examples of common cellulose ester binders which may be use in the high explosive compositions include cellulose acetate (CA), cellulose acetate butyrate (CAB), and cellulose acetate propionate (CAP). Other polymeric binders may be used with proper selection of solvent systems. For instance, Dupont Hytrel thermoplastic elastomers may be used with a methylene chloride solvent. The high explosive compositions processed according to the present invention typically contain from 4% to 8% binder, by weight.

Plasticizers used in the explosive compositions are preferably energetic. Known and novel energetic plasticizers may be used, such as bis(2,2-dinitropropyl)acetal/bis(2,2-dinitropropyl)formal (BDNPF/BDNPA), trimethylolethane-trinitrate (TMETN), triethyleneglycoldinitrate (TEGDN), diethyleneglycoldinitrate (DEGDN), nitroglycerine (NG), 1,2,4-butanetrioltrinitrate (BTTN), alkyl nitratoethylnitramines (NENA's), or mixtures thereof. The high explosive compositions processed according to the present invention typically contain from 2% to 16% plasticizer, by weight.

The solvent system will vary depending on the choice of oxidizer and binder. The explosive composition solvent is selected to dissolve the non-oxidizer ingredients and to adequately wet, but not dissolve, the oxidizer particles. Some solvent must be present during the final extrusion such that the binder remains plasticized. Thus, excess solvent is removed as the ingredients pass through the extruder.

Mixed solvent systems may be particularly useful in the manufacturing processes of the present invention. For instance, a mixture of solvents having different boiling temperatures may be chosen such that the excess solvent is low boiling while the high boiling solvent is present in an amount sufficient to permit extrusion of the propellant formulation. Thus, a suitable temperature profile which evaporates the excess solvent, yet retains the solvent needed for extrusion, is easily maintained.

Suitable solvents are preferably selected from commonly used organic solvents such as ketones, esters, and alcohols. Typical ketones include acetone and methyl ethyl ketone (MEK). Typical esters include acetates such as methyl acetate, ethyl acetate, and butyl acetate. Typical alcohols include methanol, ethanol, isopropyl alcohol, and propanol.

High explosive compositions have been processed by preparing a lacquer of cellulose acetate butyrate and a plasticizer (such as TEGDN and DEGDN or BDNPF/BDNPA) in a solvent mixture of ethyl acetate and ethyl alcohol. The resulting lacquer was pumped to the twin-screw extruder and ground HMX was added with a loss-in-weight feeder. The materials were compounded and the solvent content was reduced and the composition was bulk granulated as it left the extruder. The composition was then granulated in a continuous granulator and dried. The resulting explosive composition was packaged for shipment to the loading facility. The material met bulk density requirements for automatic volumetric feeding and consolidation into warheads.

The advantages of processing high explosives in a twin-screw extruder are the same as delineated for pyrotechnics and propellants. These advantages include safety, reduced cost and improved homogeneity. The safety enhancements come from the remote operation to limit exposure of personnel and the small amount of material in process that would reduce the severity of an unplanned ignition. Reduced costs come from a reduction in the manpower required to process materials, reduction in overall mix time, remote (and therefore automatic) handling of materials, limited exposure of equipment to risk, the use of smaller quantities of materials in process reduces the size of handling equipment and therefore capital costs are lower. The improved homogeneity results from the intensive mixing that occurs in a thin-film mixer as the twin-screw extruder.

From the foregoing, it will be appreciated that the present invention provides continuous processing techniques capable of producing high quality, low cost energetic materials. The present invention further provides continuous, remotely operated techniques for processing energetic materials which reduce the exposure of personnel and equipment to large quantities of bulk material. It will also be appreciated that the present invention provides energetic materials processing techniques which produce free-flowing granules having a consistent density so that volumetric materials processing equipment may be used in preparing the final energetic composition.

The present invention may be embodied in other specific forms without departing from its essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The claimed invention is:

1. A method of processing energetic materials comprising the steps of:

(a) introducing a lacquer solution into a twin-screw extruder, said lacquer solution containing a binder dissolved in a solvent;

(b) adding at least one solid reactive material ingredient into the twin-screw extruder;

(c) compounding the energetic material with the twin-screw extruder, said compounding step including the steps of mixing the solid reactive material ingredient and the lacquer solution and removing excess solvent from the energetic material/solvent mixture;

(d) granulating the energetic material with a continuous rotary granulator; and (e) drying the energetic material to form free-flowing energetic material granules.

2. A method of processing energetic materials as defined in claim 1, wherein the solid reactive material ingredient is selected from RDX (1,3,5-trinitro-1,3,5-triazacyclohexane), HMX (1,3,5,7-tetranitro-1,3,5,7-tetraazacyclooctane), and CL-20 (2,4,6,8,10,12-hexanitro-2,4,6,8,10,12-hexaazatetracyclo[5.5.0.0$^{5,9}$0$^{3,11}$]-dodecane), and mixtures thereof.

3. A method of processing energetic materials as defined in claim 1, wherein the solid reactive material ingredient is selected from magnesium, aluminum, alloys of magnesium and aluminum, and mixtures thereof.

4. A method of processing energetic materials as defined in claim 1, wherein the excess solvent is removed from the energetic material/solvent mixture to permit granulation of the energetic material.

5. A method of processing energetic materials as defined in claim 1, wherein the excess solvent is removed from the energetic material/solvent mixture during the compounding step such that the solvent content is in the range from about 5% to about 20%, by weight of the energetic material/solvent mixture.

6. A method of processing energetic materials as defined in claim 1, wherein the continuous rotary granulator includes an exterior tubular screen and an interior rotating blade.

7. A method of processing energetic materials as defined in claim 1, wherein the dried energetic material granules are further processed by pressing the granules into a desired configuration.

8. A method of processing energetic materials as defined in claim 1, wherein the dried energetic material granules are further processed by mixing the granules with a quantity of solvent to form a solvent/granule mixture and reextruding the solvent/granule mixture.

9. A method of processing energetic materials as defined in claim 1, wherein the solvent is selected from an organic ester, organic ketone, organic alcohol, and mixtures thereof.

10. A method of processing energetic materials as defined in claim 1, wherein the solvent is selected from ethyl acetate, acetone, ethyl alcohol, and mixtures thereof.

11. A method of processing a composite gun propellant comprising the steps of:

(a) introducing a lacquer solution into a twin-screw extruder, said lacquer solution containing a quantity of cellulose ester binder, nitrocellulose, and a plasticizer dissolved in a solvent;

(b) adding a quantity of dry oxidizer to the twin-screw extruder;

(c) compounding the composite gun propellant with the twin-screw extruder, said compounding step including the steps of mixing the dry oxidizer and the lacquer solution and removing excess solvent from the oxidizer/lacquer solution mixture;

(d) granulating the composite gun propellant with a continuous rotary granulator;

(e) drying the composite gun propellant to form free-flowing granules;

(f) introducing composite gun propellant granules and a quantity of solvent into an extruder such that the quantity of solvent is selected to provide a solvent content suitable for extrusion; and (g) extruding the composite gun propellant.

12. A method of processing a composite gun propellant as defined in claim 11, further comprising the steps of:

(h) cutting the extruded composite gun propellant into pellets;

(i) drying the pellets; and (j) glazing the pellets with graphite to prevent static charges.

13. A method of processing a composite gun propellant as defined in claim 11, wherein the oxidizer is selected from RDX (1,3,5-trinitro-1,3,5-triazacyclohexane), HMX (1,3,5,7-tetra-nitro-1,3,5,7-tetraazacyclooctane), and CL-20 (2,4,6,8,10,12-hexanitro-2,4,6,8,10,12-hexaazatetracyclo $[5.5.0.0^{5,9}0^{3,11}]$-dodecane), and mixtures thereof.

14. A method of processing a composite gun propellant as defined in claim 11, wherein the cellulose ester binder is selected from cellulose acetate, cellulose acetate butyrate and cellulose acetate propionate.

15. A method of processing a composite gun propellant as defined in claim 11, wherein the cellulose ester binder has a concentration in the composite gun propellant in the range from about 10 to about 15 weight percent.

16. A method of processing a composite gun propellant as defined in claim 11, wherein the plasticizer is selected from bis(2,2-dinitropropyl)acetal/bis(2,2-dinitropropyl)formal (BDNPF/BDNPA), trimethylolethanetrinitrate (TMETN), triethyleneglycoldinitrate (TEGDN), diethyleneglycoldinitrate (DEGDN), nitroglycerine (NG), butanetrioltrinitrate (BTTN), alkyl nitratoethylnitramines (NENA's), and mixtures thereof.

17. A method of processing a composite gun propellant as defined in claim 11, wherein the plasticizer is selected from triacetin, acetyltriethylcitrate (ATEC), dioctyladipate (DOA), isodecylperlargonate (IDP), dioctylphthalate (DOP), dioctylmaleate (DOM), dibutylphthalate (DBP), and mixtures thereof.

18. A method of processing an infrared flare composition comprising the steps of:

(a) introducing a lacquer solution into a twin-screw extruder, said lacquer solution containing a quantity of binder dissolved in a solvent and PTFE dispersed therein;

(b) adding a quantity of metal particles to the twin-screw extruder;

(c) compounding the flare composition with the twin-screw extruder, said compounding step including the steps of mixing the metal particles and the lacquer solution and removing excess solvent from the oxidizer/lacquer solution mixture; and (d) granulating the flare composition.

19. A method of processing an infrared flare composition as defined in claim 18, wherein the binder is a polyacrylate rubber.

20. A method of processing an infrared flare composition as defined in claim 18, wherein the binder is a fluoroelastomer rubber.

21. A method of processing an infrared flare composition as defined in claim 18, wherein the solvent is acetone.

22. A method of processing an infrared flare composition as defined in claim 18, wherein the metal particles comprise magnesium particles.

23. A method of processing an infrared flare composition as defined in claim 18, wherein the metal particles have a concentration in the infrared flare composition in the range from about 60 to about 70 weight percent.

24. A method of processing an infrared flare composition as defined in claim 18, further comprising the steps of drying the granulated flare composition and pressing the flare composition into a desired flare configuration.

25. A method of processing an infrared flare composition as defined in claim 18, further comprising the steps of drying the granulated flare composition and extruding the flare composition into a desired flare configuration.

26. A method of processing a high explosive composition comprising the steps of:

(a) introducing a lacquer solution into a twin-screw extruder, said lacquer solution containing a quantity of cellulose ester binder and a plasticizer dissolved in a solvent;

(b) adding a quantity of oxidizer to the twin-screw extruder;

(c) compounding the composite gun propellant with the twin-screw extruder, said compounding step including the steps of mixing the dry oxidizer and the lacquer solution and removing excess solvent from the oxidizer/lacquer solution mixture;

(d) granulating the high explosive composition with a continuous rotary granulator; and (e) drying the high explosive composition to form free-flowing granules.

27. A method of processing a high explosive composition as defined in claim 26, wherein the oxidizer is selected from RDX (1,3,5-trinitro-1,3,5-triazacyclohexane), HMX (1,3,5,7tetranitro-1,3,5,7-tetraazacyclooctane), CL-20 (2,4,6,8,10,12-hexanitro-2,4,6,8,10,12-hexaazatetracyclo $[5.5.0.0^{5,9}0^{3,11}]$-dodecane), dodecane), ADN (ammonium dinitramide), TNAZ (1,3,3-trinitroazetidine), and mixtures thereof.

28. A method of processing a high explosive composition as defined in claim 26, wherein the oxidizer has a concentration in the high explosive composition in the range from about 80 to about 90 weight percent.

29. A method of processing a high explosive composition as defined in claim 26, wherein the cellulose ester binder is selected from cellulose acetate, cellulose acetate butyrate and cellulose acetate propionate.

30. A method of processing a high explosive composition as defined in claim 26, wherein the cellulose ester binder has a concentration in the high explosive composition in the range from about 10 to about 15 weight percent.

31. A method of processing a high explosive composition as defined in claim 26, wherein the plasticizer is selected from bis(2,2-dinitropropyl)acetal/bis(2,2-dinitropropyl)formal (BDNPF/BDNPA), trimethylolethanetrinitrate (TMETN), triethyleneglycoldinitrate (TEGDN), diethyleneglycoldinitrate (DEGDN), nitroglycerine (NG), butanetrioltrinitrate (BTTN), alkyl nitratoethylnitramines (NENA's), and mixtures thereof.

* * * * *